US008569670B1

(12) United States Patent
Carlucci et al.

(10) Patent No.: US 8,569,670 B1
(45) Date of Patent: Oct. 29, 2013

(54) PRESSURE ACTIVATED INERTIALLY LOCKING BASE FOR PROJECTILES

(75) Inventors: Donald Carlucci, Sparta, NJ (US); David Geissler, Mount Arlington, NJ (US); John Thomas, Morris Plains, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/476,451

(22) Filed: May 21, 2012

Related U.S. Application Data

(63) Continuation-in-part of application No. 12/634,926, filed on Dec. 10, 2009, now abandoned.

(60) Provisional application No. 61/121,250, filed on Dec. 10, 2008.

(51) Int. Cl.
*F42B 15/01* (2006.01)

(52) U.S. Cl.
USPC ..... 244/3.28; 244/3.24; 244/3.26

(58) Field of Classification Search
USPC ..... 244/3.1, 3.24, 3.26, 3.27, 3.28
See application file for complete search history.

(56) References Cited

U.S. PATENT DOCUMENTS

| | | | | |
|---|---|---|---|---|
| 6,571,715 | B1 * | 6/2003 | Bennett et al. | 102/439 |
| 6,588,700 | B2 * | 7/2003 | Moore et al. | 244/3.28 |
| 6,880,780 | B1 * | 4/2005 | Perry et al. | 244/3.27 |
| 6,948,685 | B2 * | 9/2005 | Hawthorne | 244/129.1 |
| 7,083,140 | B1 * | 8/2006 | Dooley | 244/3.27 |
| 8,312,813 | B2 * | 11/2012 | McDermott et al. | 102/490 |
| 2003/0071166 | A1 * | 4/2003 | Moore et al. | 244/3.28 |
| 2004/0108412 | A1 * | 6/2004 | Moore et al. | 244/3.24 |

* cited by examiner

*Primary Examiner* — Philip J Bonzell
(74) *Attorney, Agent, or Firm* — Henry S. Goldfine

(57) ABSTRACT

An advance is made in the art according to an aspect of the present invention disclosure directed to a pressure-activated, inertially locking base and fin mechanism for projectiles. Operationally, a base housing of a projectile contains both the fins, held within slots within the base, and a plunger. Which plunger has plurality of channels communicating with a chamber within base and which plunger is initially situated flush with the base. Upon firing the chamber is pressurized by the high-pressure firing gases being forced through the channels. When the projectile exits the barrel, the chamber's pressure vents through the channels, but, not fast enough to avoid a pressure differential that forces the plunger out of the base, causing a set of spring arms to flex upward and deploy the fins. When fully deployed, the fins are locked in place, in the deployed position, by a spring loaded pin.

6 Claims, 7 Drawing Sheets

PRESSURE ACTIVATED INERTIALLY LOCKING BASE FOR PROJECTILES

CROSS REFERENCE TO RELATED APPLICATION

This application is a continuation-in-part of presently copending U.S. patent application Ser. No. 12/634,926, which application claims the benefit of U.S. Provisional Patent Application Ser. No. 61/121,250, filed Dec. 10, 2009; and further, both U.S. patent application Ser. No. 12/634,926 and U.S. Provisional Patent Application Ser. No. 61/121,250 are incorporated by reference as if set forth at length herein.

U.S. GOVERNMENT INTEREST

The inventions described herein may be manufactured, used, and licensed by or for the U.S. Government for U.S. Government purposes.

FIELD OF THE DISCLOSURE

This disclosure relates generally to the field of artillery, and more particularly, it pertains to a pressure activated mechanism for projectiles which deploys flight stabilizing fins after firing thereof.

BACKGROUND OF THE DISCLOSURE

In order to further stabilize and control the flight of guided artillery projectiles, fins have been added to their design. As can be appreciated, in order to fire the artillery projectile from a barrel—for example—the fins must be fully folded-in or stowed inside the minimum diameter of the barrel during firing.

One design of foldable fins employs a hood which covers the fins during firing and which is discarded after the projectile leaves the barrel. Since the hood flies downrange upon discard, a safety hazard is created for persons or objects in that downrange direction. Such that there is a need in the art for an alternative method to deploy fins to stabilize and control flight, that does not suffer from such a safety hazard.

SUMMARY OF THE DISCLOSURE

An advance is made in the art according to an aspect of the present invention disclosure that is directed to a pressure-activated, inertially-locking base and fin deployment mechanism, for barrel fired projectiles, that does not suffer from the problems of the prior art. The invention comprising a method of extending and locking fins upon firing of a projectile from a weapon barrel, either rifled or unrifled, which includes the steps of: (1) providing said projectile having a housing with a base, and with a base portion extending from said base, the base portion containing a plurality of slots penetrating and extending into said housing, each slot having a top and bottom, the top being located on the side of the slot closest to the nose of the projectile, and the bottom being located on the opposite side of the slot closest to the base of the projectile; (2) stowing within each slot a fin, each fin mounted to the base so as to rotate about a pivot point to move to a deployed position, wherein said fin extends from said housing to help stabilize the flight of said projectile; (3) and wherein said pivot point is located near the bottom of each slot and toward the outside of the slot; (4) and wherein the center of gravity of each fin is such that it is stable in such a stowed position; (5) providing a plunger which has a lower side which is aligned with and seals the base of the projectile prior to firing thereof and which plunger has an upper side, at least a portion of which is in communication with a chamber; (6) providing a plurality of relatively small passages through said plunger that allow pressure communication between the lower side of the projectile base and a said chamber; (7) firing said projectile, such that said chamber is pressurized thereby; (8) whereby, upon the projectile exiting the barrel, a pressure differential is created between the chamber and the lower side of the plunger, such that the plunger extends from the base of the projectile, causing a set of spring arms to contact and motivate the fins to rotatably deploy from the slots; and (9) whereby, once the fins are deployed, a spring loaded shaft or pin, which had been blocked from movement by the stowed fins themselves, is freed to move and does move to a position behind each fin, to lock each fin in the desired deployed position.

BRIEF DESCRIPTION OF THE DRAWING

A more complete understanding of the present invention disclosure may be realized by reference to the accompanying drawings in which:

FIG. 1(*b*) is a schematic diagram showing side and bottom views of the representative projectile base housing of FIG. 1(*a*) showing fin deployment and plunger activation;

FIG. 2(*b*) is a schematic diagram showing the deployed fin(s) and spring arms and plunger mechanism upon activation according to an aspect of the present invention disclosure;

FIG. 2(*c*) is a schematic diagram showing a close-up of the fin(s) and springs and plunger mechanism and seal(s) according to an aspect of the present invention disclosure.

FIG. 2(*d*) is a schematic diagram showing a close-up of the sealing gasket in relation to the structures shown in FIGS. 2 (*a*)-(*c*), according to an aspect of the present invention disclosure.

FIG. 2(*e*) is a cross-sectional view of a preferred embodiment of the present invention.

DETAILED DESCRIPTION

Figure 1A:
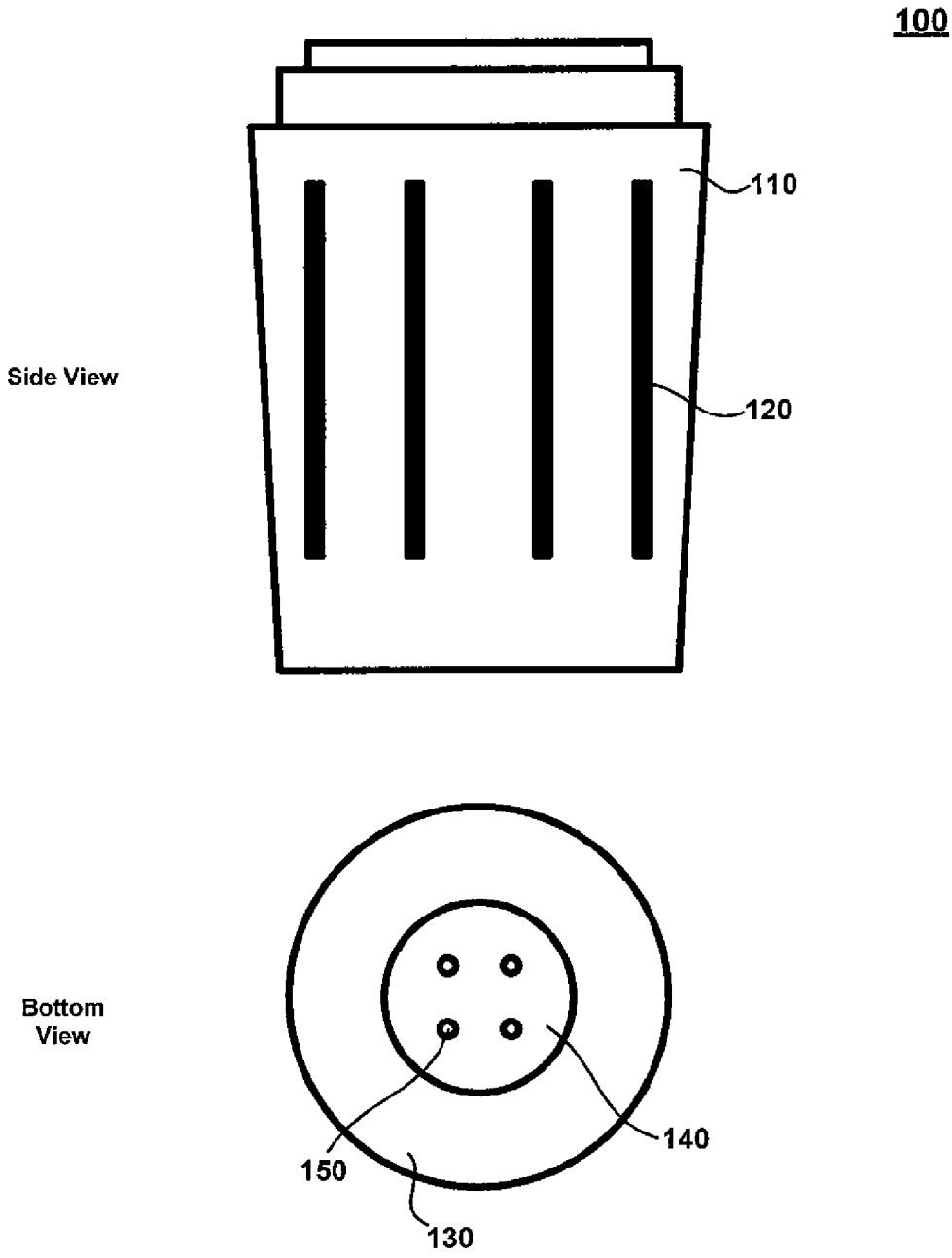
FIG. 1(*a*) is a schematic diagram showing side and bottom views of a representative projectile base housing according to an aspect of the present invention disclosure.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Operationally, the present invention comprises a base housing of a projectile which contains a set of folded-in flight stabilizing fins, chambered within a set of slots within the housing, and a plunger, which plunger has a plurality of relatively small diameter passages or channels therethrough; which passages allow gas flow and pressure equalization between the exterior of the plunger and a chamber within the base housing (which chamber is preferably hemispheric—to better withstand the pressures to which it will be subjected). Upon firing, the plunger is situated flush with the base and remains so as long as the projectile is contained within the barrel (i.e. the gun tube), due to the high pressure therein (i.e. up to about 10,000 psi)—pressure caused by the firing detonation of the explosive propellant charge. Also, as long as, the projectile is contained within the barrel, the chamber within the base housing becomes and remains pressurized (up to a pressure approaching that external to the plunger) via the aforementioned passages. Such that, when the projectile exits the barrel and a precipitous external pressure drop to ambient pressure occurs—the high pressure within the chamber will begin venting out of the passages. However this venting will be inhibited due to the relatively small diameter of the passages, i.e. choked flow; such that, the pressure within the chamber will be, for a period of time after the projectile exits the barrel, significantly higher than the ambient atmospheric pressure. This pressure differential will force the plunger into motion, out of the base, in a rearward direction (opposite that of travel of the projectile). Which motion of the plunger will cause a set of spring arms to flex generally upward (i.e. generally toward the front of the projectile, in the direction of travel) and generally outward (i.e., generally away from the longitudinal center line of the plunger), thereby contacting and urging the fins to rotate about a pivot point, such that the fins deploy out of the slots within the housing. When fully deployed, each fin is locked in place in the deployed position, by a spring loaded pin—which pin is freed to move when each fin deploys.

As detailed above, in the subject invention, the fins are initially stowed or folded-in in the base housing. The fins will remain in such a stowed position, until urged therefrom by the motion of the above described spring arms, as the center of gravity of each fin is such as to make each fin stable within its initial folded-in, i.e. stowed position, within each slot. Further, as generally described above, when the plunger moves rearward and forces said spring arms to flex upwards and outwards—the spring arms contact the stowed fins in an off-center manner, so as to motivate the fins to rotate about a pivot point located in the fins rear lower corner (i.e. the corner of the fin located and toward the outside of the slot, i.e. toward the outside or periphery of the projectile). As the fin then begins to move, under such urging by the spring arm, the center of gravity of the fin will be relocated radially outward toward the outside of periphery of the projectile; such that, when the fin begins to deploy out of the slot—the new center of gravity of the fin will cause it to keep deploying and to remain deployed. And, in the event that the particular barrel is rifled and the projectile spinning—the force of the spin will further aid in the deployment of the fin (once the motion is initiated by the urging of the spring arm). Further, as stated above, there is a set of spring loaded pins, which once the fin becomes deployed, is free to exit the channel in which each spring loaded pin is initially held, and to move behind the extended fin—to ensure the each fin remains fully deployed, i.e. by locking that each deployed fin in the desired deployed position, extending from the projectile housing, to provide stable flight for the projectile.

Figure 1B:
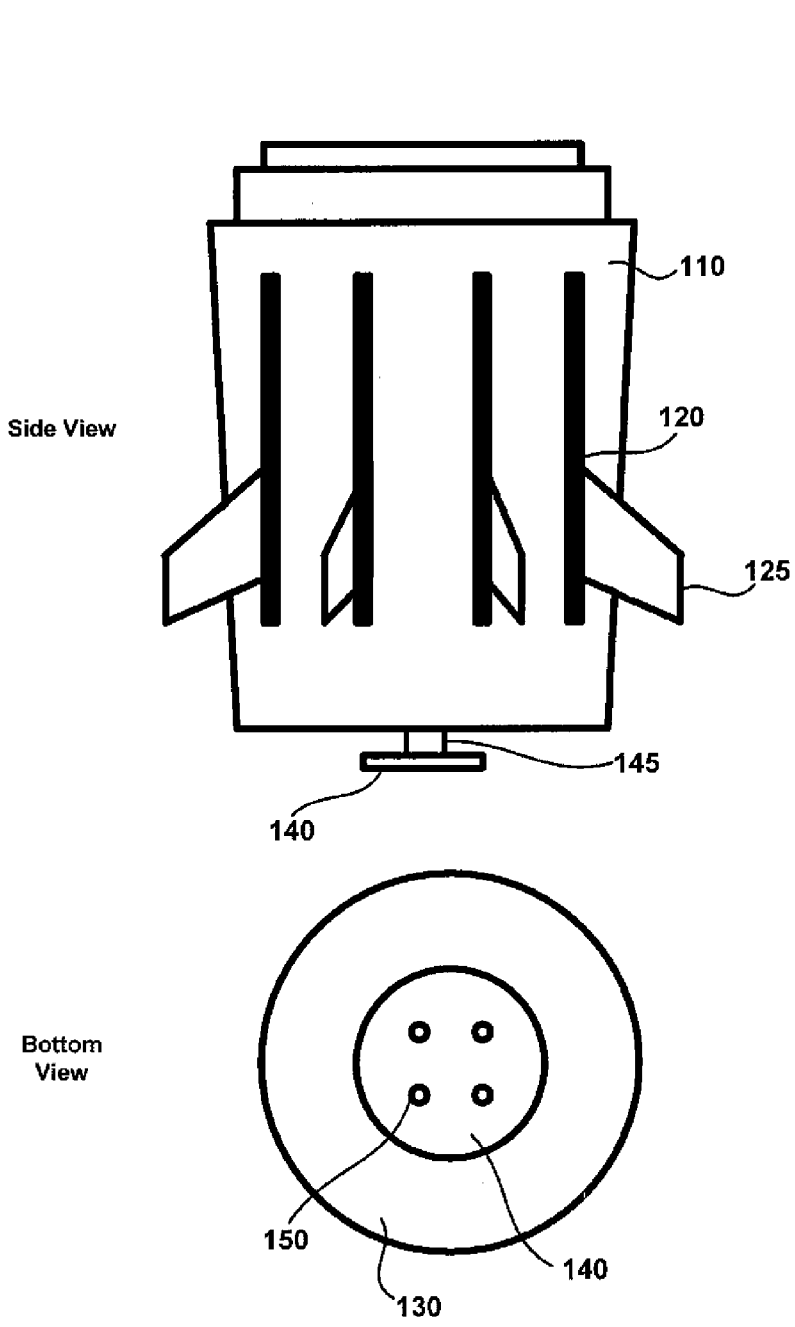
Figure 2A:
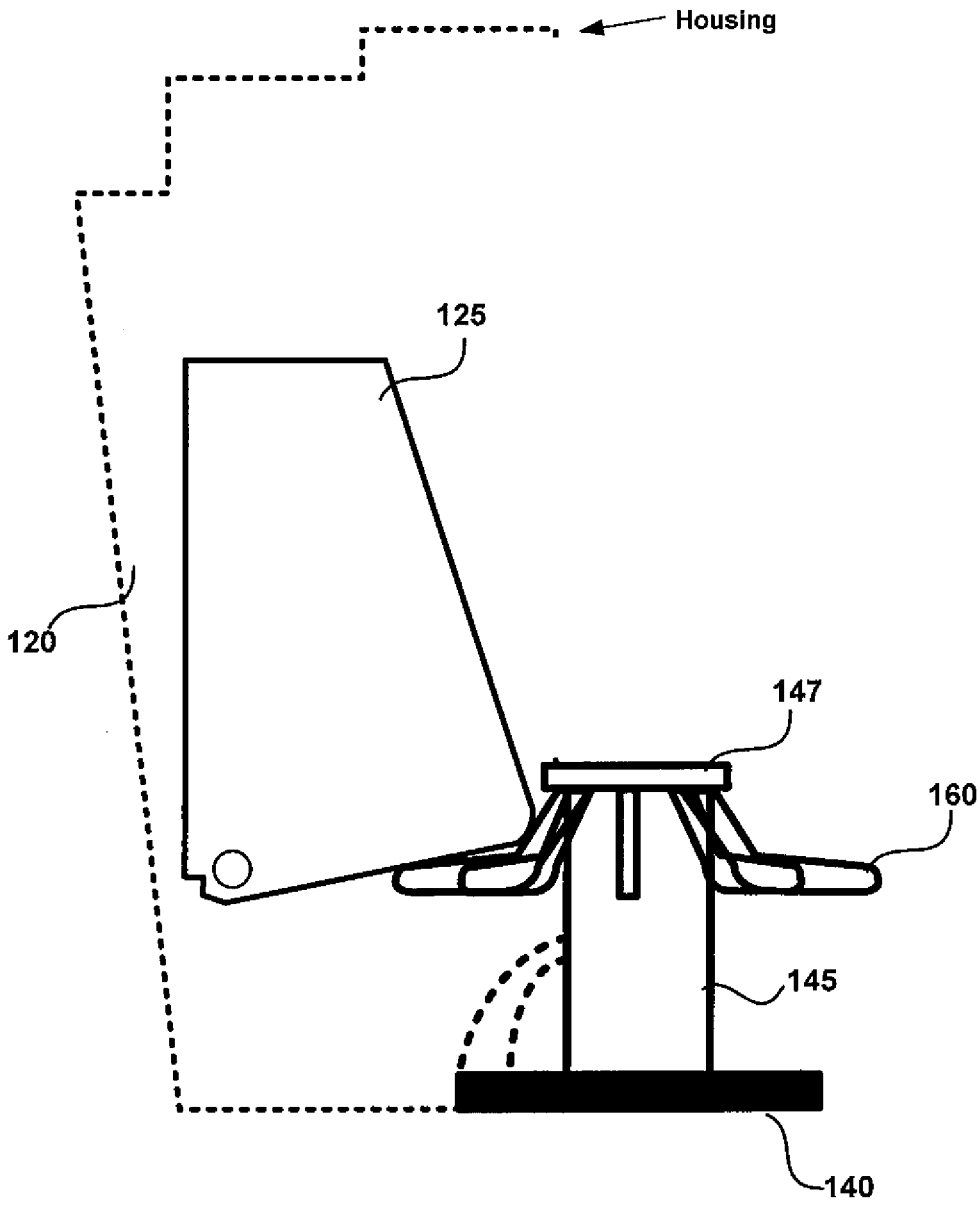
FIG. 2(*a*) is a schematic diagram showing the fins) and spring arms and plunger mechanism according to an aspect of the present invention disclosure.
Figure 2B:
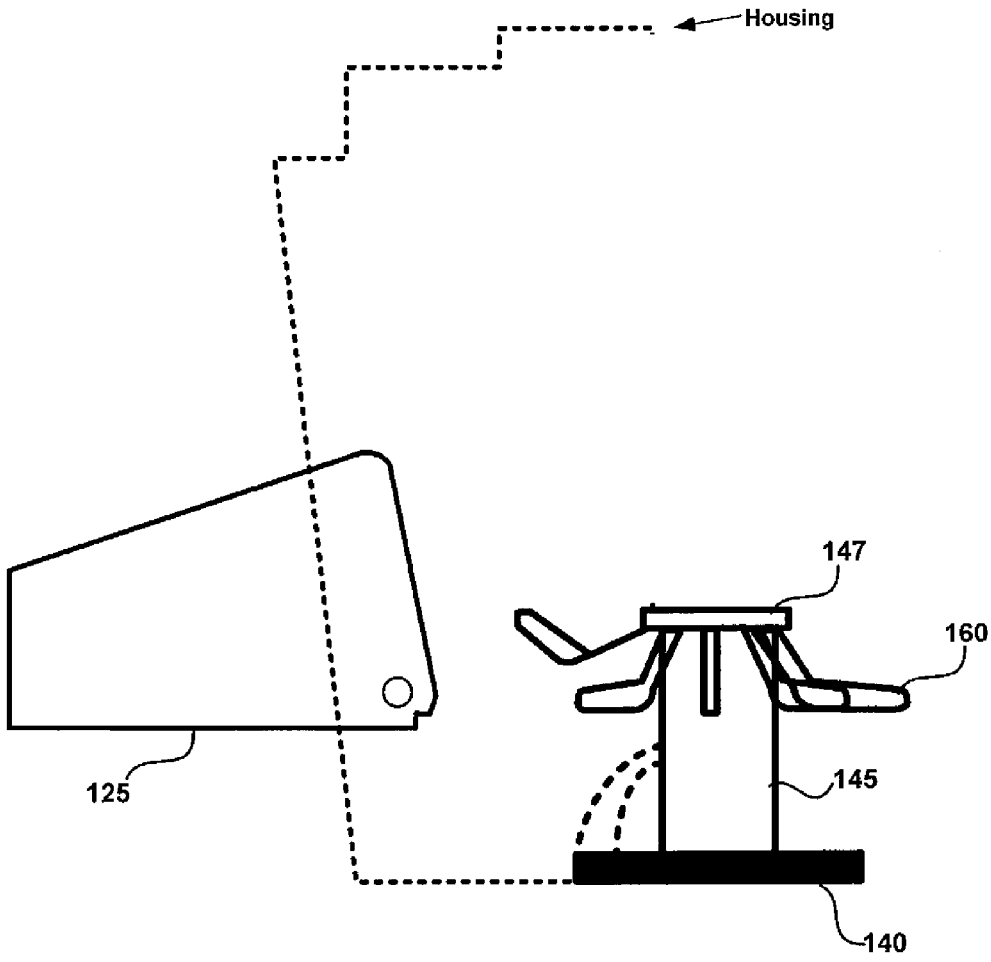
Figure 2C:
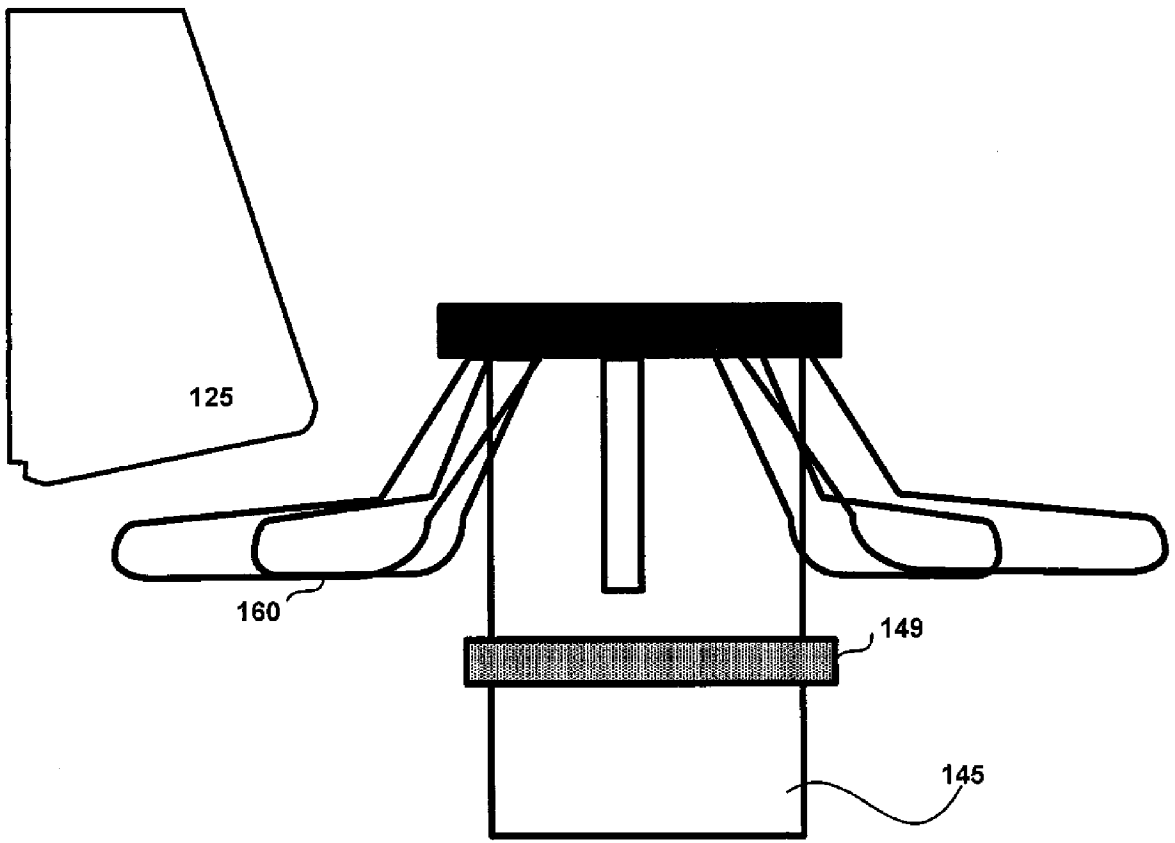
Figure 2D:
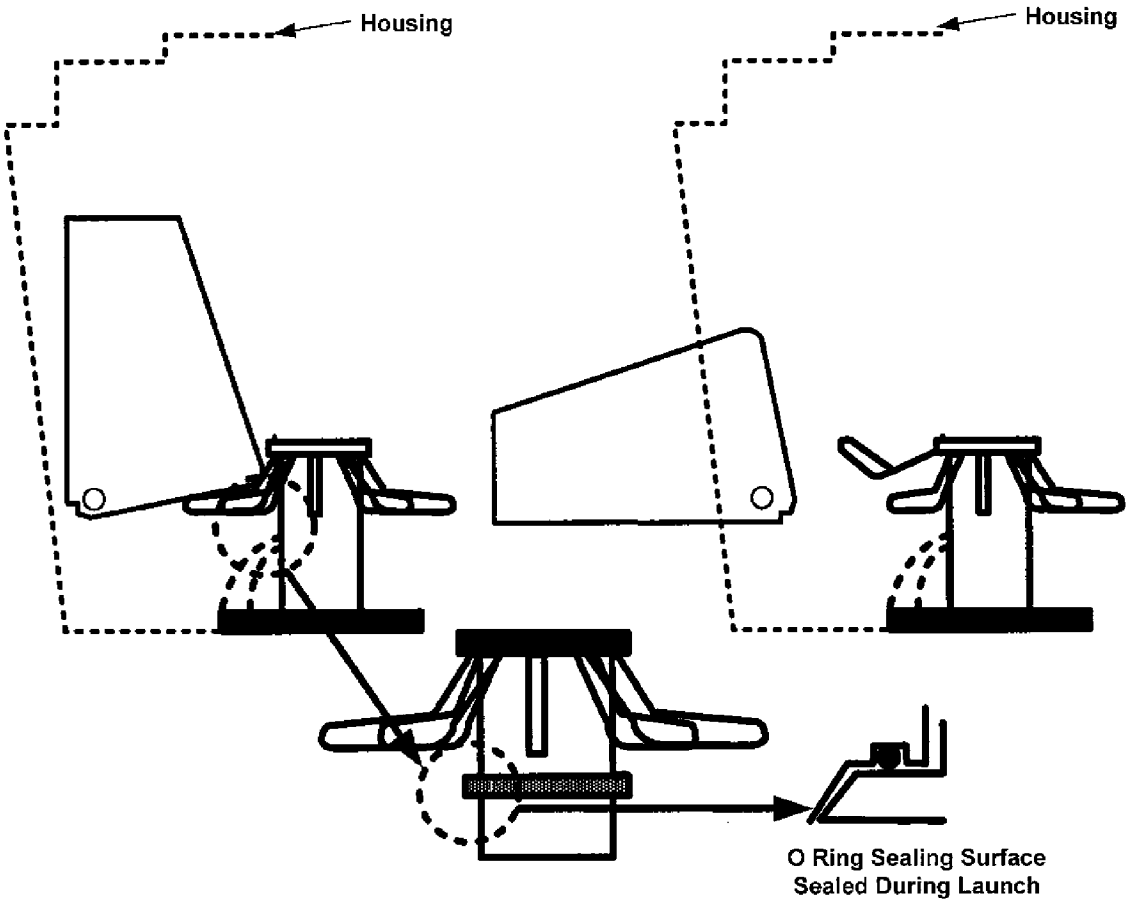
Figure 2E:
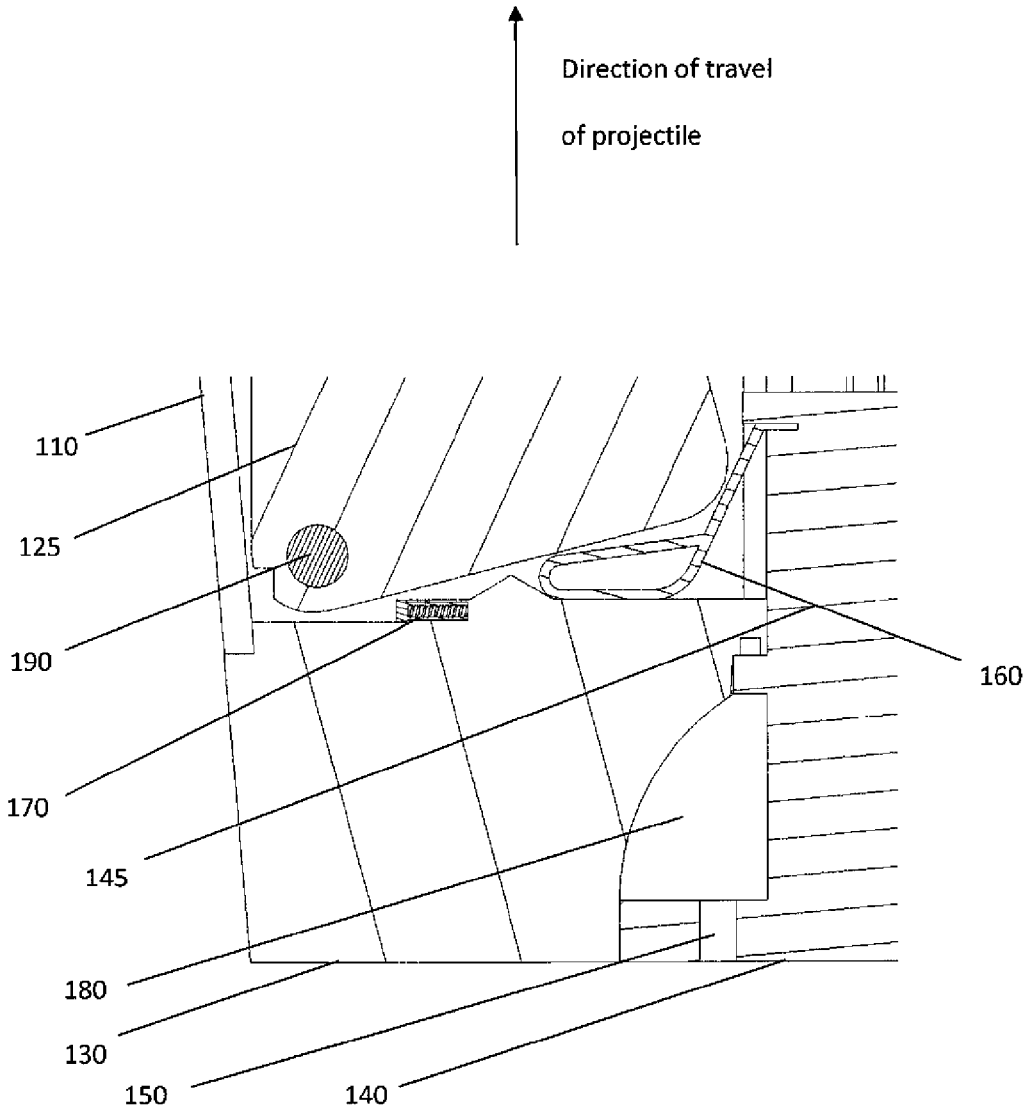

More specifically, with reference now to FIG. 1, there is shown a simple schematic diagram of a side and bottom views of a projectile base housing assembly 100 according to an aspect of the present invention. As generally show, the assembly 100 includes a housing 110 includes a plurality of fin slots 120 disposed around a perimeter of the housing 110. A bottom or base 130 of the housing 110 forms a lower surface of the housing in which is positioned a plunger having a lower face 140 which forms a pressure seal with the housing base. One or more passages 150 formed in the face of the plunger 140 allow a "pressure communication" between the outside of the housing and an interior portion of the housing when the plunger is sealed with the face of the base 130.

FIG. 1(*b*) is a simple schematic diagram of the projectile base housing assembly 100 after firing. As may be observed from that FIG. 1(*b*), the fins 125 are deployed and the plunger face 140 is extended from the base 130 exposing its inner body 145.

With reference now to that FIG. 2(*a*) there is shown an interior schematic view of the projectile base housing. In this FIG. 2(*a*), shown are the fin slots 120, the fins 125, the plunger body 145, its face 140 and the spring arms 160. As shown in FIG. 2(*a*), the plunger is closed and sealed against the base housing. In addition, it may be seen that there are a plurality of spring arms 160 shown as generally disposed around the circumference of the plunger head 147. When the projectile exits the gun tube, the pressure that has built up inside the chamber (as discussed above) pushes downward the plunger causing spring arms to flex upward (away from the plunger face 140), to contact with and motivate the fins 125 to deploy. In deploying the fins 125 merely rotate about a pivot or pin point 190 at which the fins 125 are rotatably joined to the interior of each slot 120 (by well known technology in the art). When fully deployed, the fins 125 are locked in the deployed position and thereby stabilize the projectile during its flight.

With reference now to FIG. 2(*b*), there is shown an interior schematic view of the projectile base housing after launch and subsequent to fin deployment. As shown, upon launch the external pressure to the housing drops sufficient that the interior pressure extends the plunger such that its face 140 extends beyond the base of the housing. As a result, the spring arms 160 flex upward urging and the extended fins 125 to deploy.

Turning now to FIG. 2(*c*), there is shown an exploded view of the interior schematic of the projectile housing. Shown in this FIG. 2(*c*), is a close up of the plunger body 145. As can be appreciated, the plunger body comprises a sliding shaft which extends from the base of the housing after projectile launch. In a preferred embodiment, the plunger body may include a shaft flange 149 including a seal to further seal the internal pressure during the launch of the projectile. In this manner, the seal may engage a perimeter, top portion of the flange 149 such that the internal pressure is maintained until after the projectile leaves the barrel.

FIG. 2(*d*) is a close-up of a seal and flange for sealing the base housing, to control build-up of pressure within the housing during launch/firing. More particularly, when the plunger is fully inserted into the base housing, the housing is sufficiently sealed to contain the high pressure gases which fill the chamber therein via the aforementioned channels, pressure that results from firing the projectile out of a barrel. And, as described, upon exiting from the barrel, the pressure external to the base housing is sufficiently lower than the internal pressure such that the plunger moves so as to extend below the base of the housing, thereby activating a set of spring arms, which cause the fin deployment, and subsequent locking of the fins in the desired deployed position.

FIG. 2(*e*) is a cross-sectional view of a preferred embodiment of the present invention, wherein a fin 125 is shown in the stowed position within the housing 110 prior to firing. As detailed above, upon firing of the subject projectile, the plunger face 140 is situated flush with the base 130 and remains so as long as the projectile is contained within the barrel (i.e. the gun tube), due to the high pressure therein (i.e. up to about 10,000 psi)—pressure caused by the firing detonation of the explosive propellant charge. Also, as long as, the projectile is contained within the barrel, the chamber 180 within the base housing becomes and remains pressurized (up to a pressure approaching that external to the plunger) via the aforementioned passages 150 or channels. Such that, when the projectile exits the barrel and a precipitous external pressure drop to ambient pressure occurs—the high pressure within the chamber will begin venting out of the passages 150. However this venting will be inhibited due to the relatively small diameter of the passages 150, i.e. basically "choked flow"; such that, the pressure within the chamber 180 will be, for a period of time after the projectile exits the barrel, significantly higher than the ambient atmospheric pressure. This pressure differential will force the plunger into motion, out of the base 130, in a rearward direction (opposite that of travel of the projectile—indicated by the arrow and words "Direction of travel of projectile"). Which motion of the plunger will cause a set of spring arms 160 to flex generally upward (i.e. generally toward the front of the projectile, in the direction of travel thereof) and generally outward (i.e., generally away from the longitudinal center line of the plunger); thereby contacting and urging the fins 125 to rotate about a pivot point 190, such that the fins 125 deploy out of the slots 120 within the housing 110. When fully deployed, each fin is locked in place in the deployed position, by a spring loaded pin 170—which pin is freed to move when each fin deploys; but, which where each pin 170 is physically blocked by each fin 125, until the fin 125 moves into its deployed position. Once the spring loaded pin 170 is free to move, it moves behind the deployed fin such that it will hold the fin in place, i.e. locking each fin in its deployed position.

As detailed above and also shown in FIG. 2(*e*), in the subject invention, the fins 125 are initially stowed or folded-in into the housing 110. The fins 125 will remain in such a stowed position, until urged therefrom by the motion of the above described spring arms 160, as the center of gravity of each fin 125 is such as to make each fin 125 stable within its initial folded-in or stowed position, within each slot 120. Further, as generally described above, when the plunger moves rearward and forces said spring arms 160 to flex upwards and outwards—the spring arms contact the bottom of the stowed fins 125 in an off-center manner, so as to motivate the fins to rotate about a pivot point 190 located in the fins 125 rear lower corner (i.e. the corner of the fin located toward the rear side of the projectile and toward the outside of the slot—toward the outside or periphery of the projectile). As each fin 125 then begins to move, under such urging by the spring arm 160, the center of gravity of the fin 125 will be relocated radially outward toward the outside of periphery of the projectile; such that, when the fin 125 begins to deploy out of the slot 120—the new center of gravity of the fin 125 will cause it to keep deploying and to remain deployed. Further, as stated above, there is a set of spring loaded pins 170, which once the fin deploys is free to exit the channel in which each spring loaded pin 170 is initially held, and to extend behind the deployed fins 125—to ensure the each fin remains fully deployed.

As stated above, in the present invention, the passages 150 are relatively small in relationship to the plunger base 140 diameter and there are from about 2 to about 8 of such passages 150, preferably 3 to 6 thereof, and most preferably, from about 4 to about 5 thereof. Further, and preferably, the diameter of the passages 150, or channels (which are substantially circular in cross-section) are from about 1/64 to about 3/16 of the diameter of the plunger base 140. More preferably, the diameter of the passages 150 are from about 1/16 to about 5/64 of the diameter of the plunder base 140.

The present invention may optionally further comprise a cover over each slot 120 to keep dirt or other debris from entering the slot 120 and in any way interfering with or blocking the deployment of the fin 125 therein. Such covers can be any plastic or other light weight material which is glued or otherwise fastened over each slot 120—in a fashion so as not to impede the deployment of each fin 125.

At this point, while we have discussed and described the invention using some specific examples, those skilled in the art will recognize that our teachings are not so limited. Accordingly, the invention should be only limited by the scope of the claims attached hereto.

The invention claimed is:

1. A method of extending and locking fins upon firing of a projectile from a weapon barrel, the method comprising the steps of:

(a) providing said projectile having a housing with a base, and with a base portion extending from said base, the base portion containing a plurality of slots penetrating and extending into said housing, each slot having a top and bottom, the top being located on the side of the slot closest to the nose of the projectile, and the bottom being located on the opposite side of the slot closest to the base of the projectile;

(b) stowing within each slot a fin, each fin mounted to the base so as to rotate about a pivot point to move to a deployed position, wherein said fin extends from said housing to help stabilize the flight of said projectile;

(c) and wherein said pivot point is located near the bottom of each slot and toward the outside of the slot;

(d) and wherein the center of gravity of each fin is such that it is stable in such a stowed position;

(e) providing a plunger which has a lower side which is aligned with and seals the base of the projectile prior to firing thereof and which plunger has an upper side, at least a portion of which is in communication with a chamber;

(f) providing a plurality of relatively small passages through said plunger that allow pressure communication between the lower side of the projectile base and a said chamber;

(g) firing said projectile, such that said chamber is pressurized thereby;

(h) whereby, upon the projectile exiting the barrel, a pressure differential is created between the chamber and the lower side of the plunger, such that the plunger extends from the base of the projectile, causing a set of spring arms to contact and motivate the fins to rotatably deploy from the slots; and (i) whereby, once the fins are deployed, a spring loaded pin, which had been blocked from movement by the stowed fins is freed to move, and does move to a position behind the fins, to lock the fins in the desired deployed position.

2. The method of claim 1, wherein the plurality of passages is from about 2 to about 8.

3. The method of claim 1, wherein the passages have a diameter of from about 1/64 to about 3/16 of the diameter of the plunger base.

4. The method of claim 1, wherein the barrel is rifled.

5. The method of claim 1, wherein the barrel is not rifled.

6. The method of claim 1, providing a cover over each slot prior to firing of the projectile.

* * * * *